United States Patent [19]

Cooper et al.

[11] 4,322,079

[45] Mar. 30, 1982

[54] RACE SET WITH DETOUR

[75] Inventors: Julius Cooper, New Hyde Park; Neil Tilbor, Fresh Meadows, both of N.Y.

[73] Assignee: Ideal Toy Corporation

[21] Appl. No.: 198,025

[22] Filed: Oct. 17, 1980

[51] Int. Cl.[3] ..... A63F 9/14

[52] U.S. Cl. ..... 273/86 B; 273/260; 273/262

[58] Field of Search ..... 273/86 R, 86 B; 46/202, 46/262, 258, 259, 260; 104/60, 295, 296, 304, 305

[56] References Cited

U.S. PATENT DOCUMENTS

| | | | |
|---|---|---|---|
| 3,402,503 | 9/1968 | Glass et al. | 46/202 X |
| 3,466,043 | 9/1969 | McRoskey | 46/202 X |
| 3,588,111 | 6/1971 | Agarwala | 273/86 B X |
| 3,970,309 | 7/1976 | Sato | 46/202 |
| 4,141,552 | 2/1979 | Nielsen | 46/262 X |
| 4,223,476 | 9/1980 | Meyer et al. | 273/86 B X |

FOREIGN PATENT DOCUMENTS

| | | | |
|---|---|---|---|
| 2903519 | 8/1980 | Fed. Rep. of Germany | 273/86 B |

*Primary Examiner*—Anton O. Oechsle
*Attorney, Agent, or Firm*—Richard M. Rabkin

[57] ABSTRACT

A slotless toy vehicle game in which controllable toy vehicles can change lanes in substantially any location along the track includes a drone vehicle operated on the track in a direction of travel opposite that of the controllable vehicles and a detour track section in which a portion of one of the lanes has guide walls on either side thereof for directing a controllable vehicle in that lane away from and then back towards the other lane so that a controllable vehicle steered into the detour lane will avoid collision with a drone vehicle approaching the detour track section in the other lane of the track.

7 Claims, 5 Drawing Figures

RACE SET WITH DETOUR

The present invention relates to toy vehicle games, and more in particular, to a game in which controllable toy vehicles are operated on a track with a drone car and must be controlled to avoid collisions with the drone car.

In recent years a number of so-called "slotless" toy vehicle games have been developed by various manufacturers. One such game is disclosed, for example, in U.S. Pat. No. 4,078,799, the disclosure of which is incorporated herein by reference. Slotless racing games of this type have been found to be highly popular due to the fact that the toy vehicles in the game can be controlled at substantially any point along the track to transfer or switch from one lane to the other. That is, in effect, the vehicles are remotely steered by the players in order to pass one another or to pass a drone car travelling with the controllable vehicles along the track. Typically the drone car operates at a relatively constant speed and serves as an obstacle to passing by the controllable vehicle. In addition, of course, the players can control the speed of their respective controllable vehicles so that a simulated race is provided.

It is an object of the present invention to provide a slotless toy vehicle race game in which the players must control their respective toy vehicles to avoid a head-on collision with a moving obstacle.

Another object of the present invention is to provide a toy vehicle game in which head-on collisions are avoided.

A still further object of the present invention is to provide a toy vehicle game wherein a controllable toy vehicle can be steered from one lane to either of two other adjacent lanes.

In accordance with an aspect of the present invention a toy vehicle game is provided having a flat slotless track defining at least two toy vehicle lanes permitting toy vehicles to move along the track surface in two generally parallel paths of travel. At least one of the toy vehicles is a controllable toy vehicle and includes an electric motor and means for causing the vehicle to switch from one lane to the other. Current supplied to the toy vehicle through current supply strips in the track and operator operable control means are provided for controlling the supply of current to the motor and for actuating the means that cause the vehicle to switch lanes. A drone vehicle is also provided on the track constrained for movement in one of the lanes in a direction opposite to that of the controllable vehicle.

The track of the game includes a detour track section having guide walls defining a lane section in the other of the lanes from the one in which the drone vehicle is constrained to move, in order to direct a controllable toy vehicle in that other lane along a path of travel initially away from the lane containing the drone vehicle and then back towards that lane. The controllable toy vehicles on the track can then be operated to move into the detour lane before entering the detour track section in order to avoid collision with a drone vehicle in or approaching the detour track section. The detour track section has a ramp jump formed in it so that while entering the detour track section avoids collisions with the drone, there is some potential penalty to the player involved in passing through the detour.

The above, and other objects, features and advantages of this invention will be apparent in the following detailed description of an illustrative embodiment thereof, which is to be read in connection with the accompanying drawings, wherein.

Figure 1:
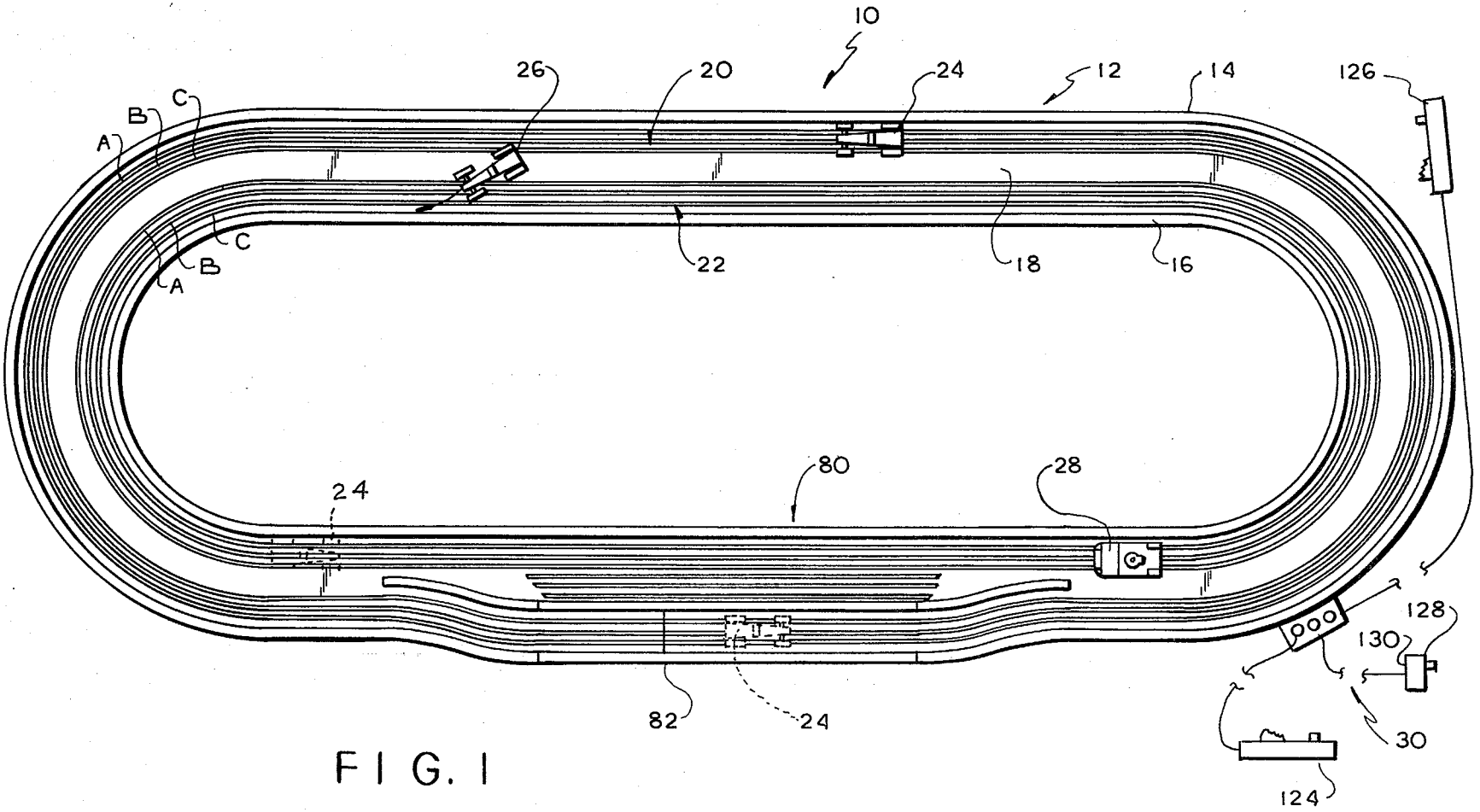
FIG. 1 is a plan view of a toy vehicle game constructed in accordance with the present invention.

Referring now to the drawings in detail, and initially to FIG. 1 thereof, a toy vehicle game 10, constructed in accordance with the present invention, includes an endless plastic track 12 having a pair of laterally spaced upstanding sidewalls 14, 16 and a road bed or tread surface 18 extending therebetween. The road bed 18 has a width sufficient to define at least two vehicle lanes 20, 22 thereon along which a plurality of toy vehicles can be operated.

In the illustrative embodiment of the present invention the toy vehicle game includes operator controlled vehicles 24, 26 which are adapted to change lanes at the command of the operator. In addition, a drone vehicle 28 is provided which, in the illustrated embodiment of the invention, moves along the track in lane 22 in a direction opposite to that of the toy vehicles 24, 26.

Vehicles 24, 26 are separately controlled by the players through a control system 30 which enables the players to vary the amount of current supplied to the electrical motors in the vehicles, thereby to vary the vehicle speed. The controllers also enable the players to change the polarity of current supplied to the respective vehicle motors whereby the vehicles can be switched by the players from one lane to the other. The drone car 28, on the other hand, moves along the track at a relatively constant speed providing an obstacle in the inner lane 22 of the track for any of the controllable vehicles driving in that inner lane.

Figure 4:
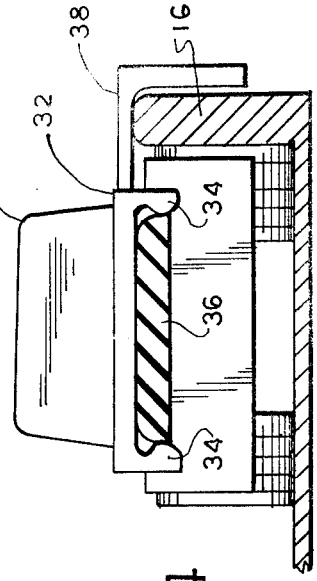
FIG. 4 is a rear view of the drone vehicle used in the game of the present invention.

Control system 30 and toy vehicles 24, 26 are of the type presently manufactured and sold by the Ideal Toy Corporation under the trademarks "TCR" and "TOTAL CONTROL RACING". The control system and the toy vehicles themselves are described in detail in U.S. Pat. No. 4,078,799. Likewise, the drone vehicle is also of a type sold by Ideal Toy Corporation in certain of its TCR games, and is disclosed in U.S. Pat. No. 4,141,552. In this embodiment of the invention, however, the drone vehicle includes a clip 32 removably secured thereto, as illustrated in FIG. 4. In particular, as seen therein the clip 32 has two resilient spaced legs 34 which snap-fit over a portion 36 of the chassis of the drone vehicle 28. In addition, clip 32 includes an extension 38 which rides over the top edge of wall 16 to constrain the drone vehicle for movement in the inner lane 22 of the track.

Figure 3:
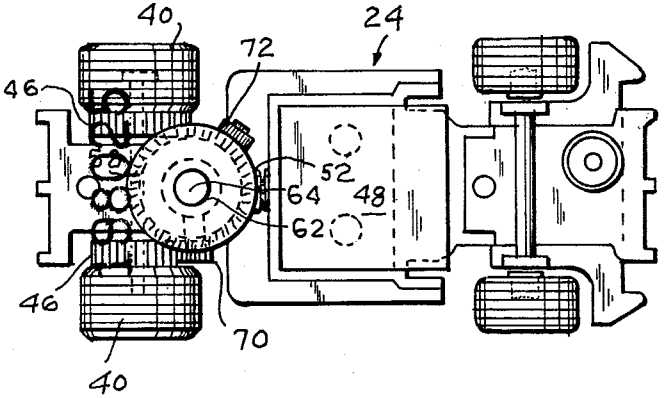
FIG. 3 is a plan view of a controllable toy vehicle adapted for use in the game of the invention.

As mentioned, controllable toy vehicle 24, 26 are of the type described in U.S. Pat. No. 4,078,799. One of the vehicles, 24, is illustrated in FIG. 3. These vehicles are responsive to current polarity reversal to selectively drive one or the other of the rear wheels 40 of the vehicle and thereby bias the vehicle into one or the other of the lanes 20, 22 of the track. In the illustrative embodiment of the invention, the toy vehicle includes an electric motor 48 having an output shaft to which a spur gear 52 is secured for rotation by the motor. The spur gear drives a crown gear 58 rotatably mounted on a central pin or post 64. A collar 62 also rotatably mounted on the pin carries a pair of angularly related spur gears 70, 72 drivingly engaged with crown gear 58. As described in U.S. Pat. No. 4,078,799, rotation of the motor output gear 52 in one or the other direction, depending upon the polarity of current supplied to the motor, will cause one of the gears 70, 72 to engage drive gear 46 associated with one or the other of rear wheels 40. When one of the rear wheels is driven, the other wheel will, essentially, free wheel so that a biasing force is applied to the toy vehicle causing it to move from one lane to the other.

Electric current is supplied to the motor of the toy vehicle through current supply strips A, B and C located in each of the track lanes. The C strips are connected to electrical ground and the A and B strips are provided to separately supply current and control polarity of the current to the respective controllable vehicles so that two controllable toy vehicles can operate in the same lane and still be separately controlled. As described in the above-mentioned U.S. Pat. No. 4,078,799, current collectors provided on the toy vehicles are arranged so that one of the toy vehicles collects current from supply strips A and the other toy vehicle collects current from supply strips B.

Figure 5:
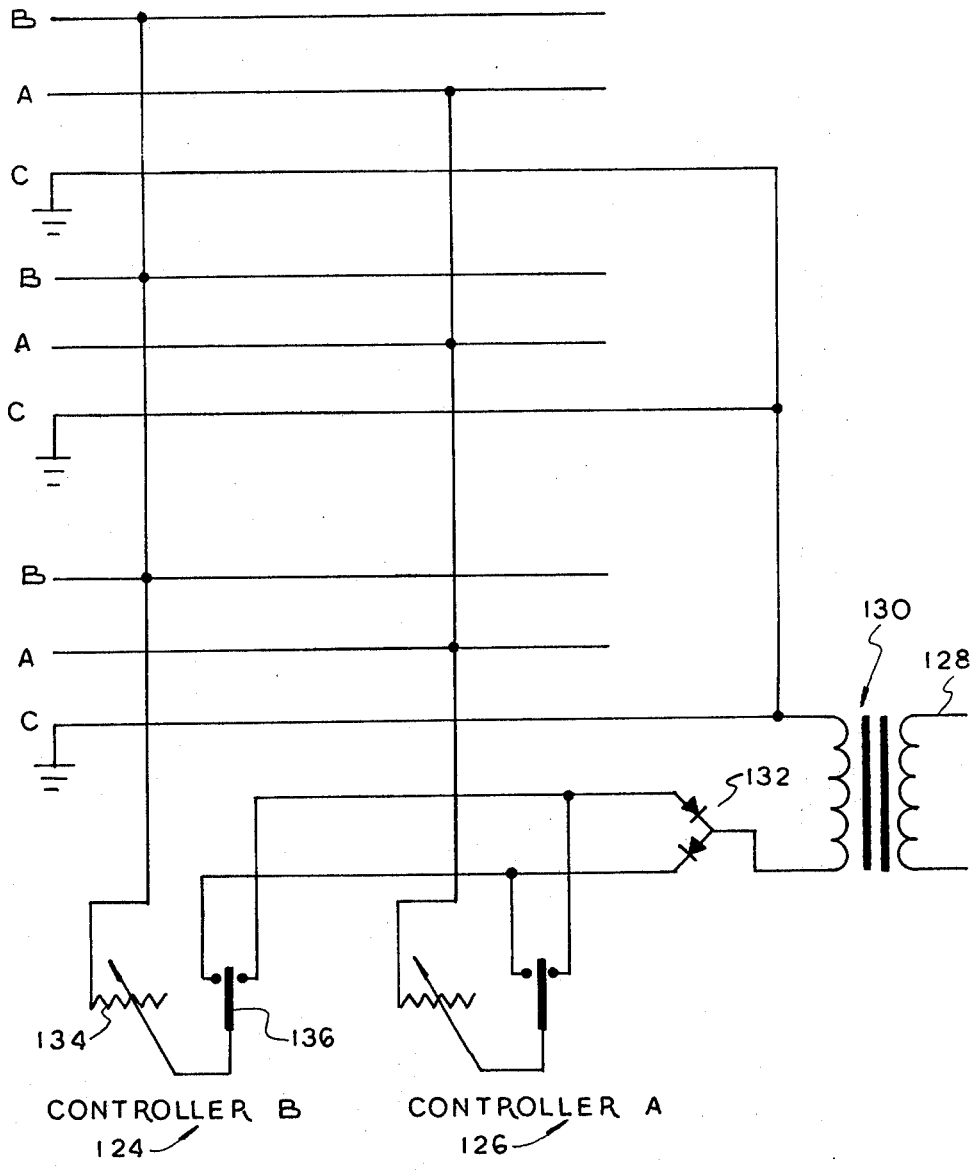
FIG. 5 is a schematic circuit diagram of the electrical control system used for the toy vehicle game of FIG. 1.

The control system for the toy vehicle game includes respective controllers 124, 126 by which the players control the toy vehicles 24, 26 respectively. The control system includes a plug 128 by which the system is connected to an electrical AC power source and a transformer 130 built into the plug. Power is supplied from transformer 130 through a half-wave rectifier 132 including two diodes connected as shown in FIG. 5 to separately supply current to controllers 124, 126. Each controller is provided as a hand-held unit and includes a variable resistor 134 operated as a trigger on the unit, as well as a single pole, double throw switch 136. Current from controller 124 is supplied through its variable resistor 134 to the contact strips B and current from controller 126 is supplied through its variable resistor to contact strips A.

The polarity of the current supplied to the toy vehicles is separately and independently controlled by switches 136 so that the polarity of current supplied to motors 48 of the respective vehicles, as controlled by the respective controllers, will vary in accordance with the position in which the switches 136 are placed. By this arrangement, using his controller, a player can control the speed of his vehicle along track 12 and he can also variably position his vehicle along the track simply by changing the polarity of current supplied to the vehicle.

As illustrated in FIG. 1, when it is desired to switch a vehicle from the outer lane to the inner lane, as shown occurring with vehicle 26, the polarity of current supplied to the vehicle is selected to drive the outer or right wheel of the vehicle thereby moving the vehicle leftwardly into the inner lane. Likewise, when it is desired to move the vehicle outwardly the inner or left wheel of the vehicle is driven by properly selecting the polarity of current supplied to the motor of the vehicles so that the vehicle will move toward the right and into the outer lane.

In the game of the present invention, with the drone vehicle 28 constrained to move in the inner lane, a moving obstacle is provided in that lane which must be avoided by the players. This can be done at most portions of the track by the player simply steering his vehicle from the inner to the outer lane. While this may involve some loss of speed as the vehicle switches lanes, it does not materially effect the race game, since the toy vehicles could move solely in the outer lane except when passing one another. However, in order to enhance the play value of the game, the detour track section 80 has been provided in the track 12 in accordance with the present invention. This detour track section makes it desirable for the players to operate their toy vehicle on the inner lane of the track as it passes through the track section in order to avoid a ramp jump 82 in the outer track section of the detour which will not only cause the vehicle to lose speed, but may cause the vehicle to fly off the track and out of the game completely. However, if the drone vehicle is approaching the detour track section from the opposite direction as a player's controllable vehicle approaches the same section in the inner lane, the player may decide it is more desirable to risk going over jump 82 rather than risk a head-on collision with the drone vehicle. Thus, the player must make a decision before entering the detour track section, and he must skillfully control his toy vehicle in order to guide it into the outer lane if necessary.

Figure 2:
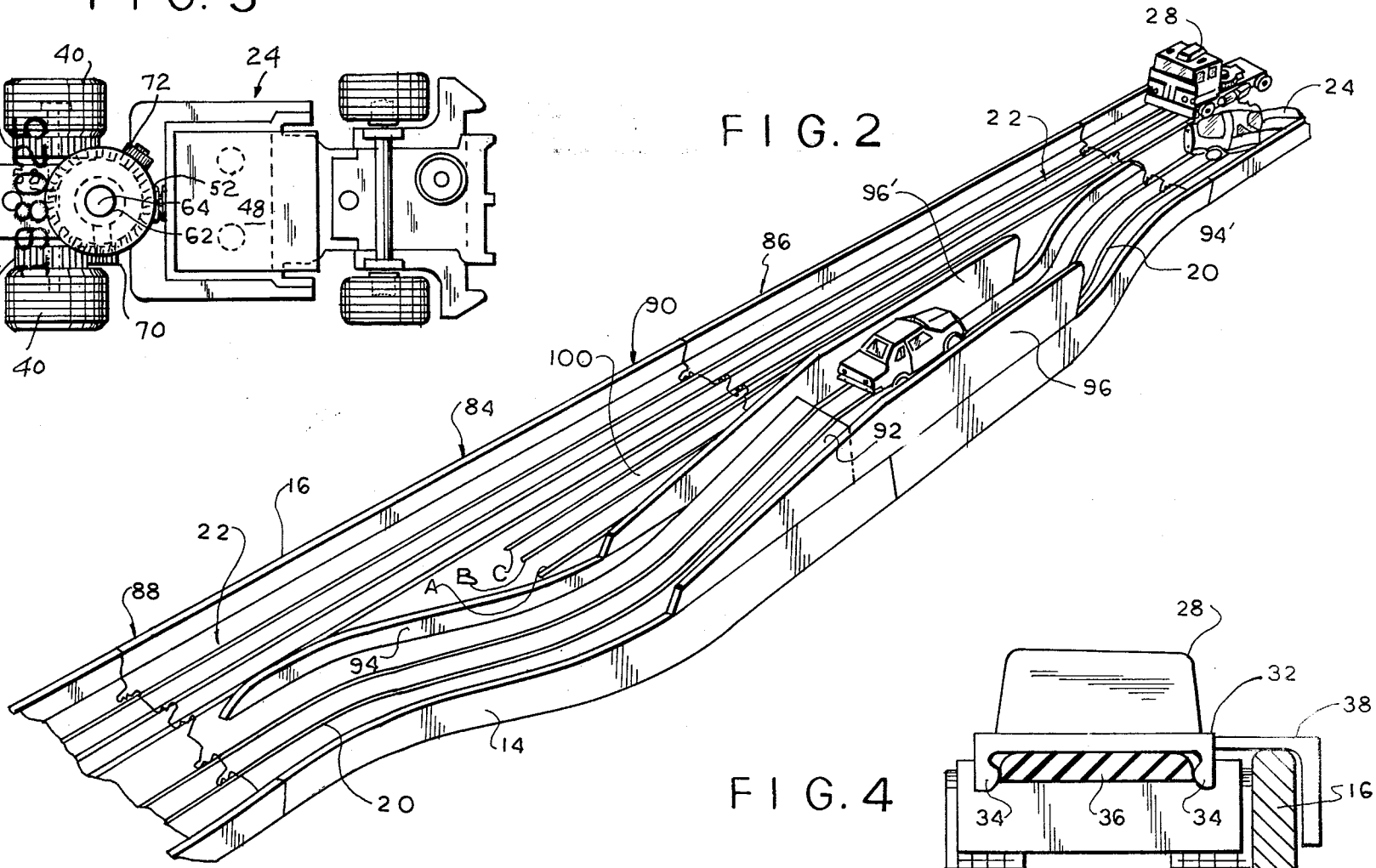
FIG. 2 is a perspective view on a larger scale of the detour track section utilizing the game of FIG. 1.

The detour track section of the present invention is illustrated in detail in FIG. 2. The track section includes two track members 84, 86. Track member 84 has a narrow end 88 which is two lanes wide and expands to an end 90 which is three lanes wide. Track section 88 includes inner wall 16 and outer wall 14, corresponding to the track walls of the remainder of the track. Inner lane 22 of this track section extends along a relatively straight path of travel from track section 84 to track section 86. On the other hand, the outer lane 20 of the track diverges from end 88 of track member 84 away from lane 22 to a molded ramp 92 formed therein. The current supply strips A, B and C in the track 10 are supplied along the lanes 20, 22 within track members 84,86.

The ends of track members 84, 86 are formed to connect in an axial direction, in the same manner as the track disclosed in U.S. Pat. No. 4,106,695.

Track section 84 includes an additional inner wall 94 formed between lanes 20 and 22. As seen in FIG. 2, wall 94 curves away from track 22 towards ramp 92. This wall, in conjunction with wall 92, will hold a toy vehicle in outer lane 20 and guide it along the defined path of travel toward ramp 92 without control by the player. When the toy vehicle reaches the end of the ramp, as illustrated in FIG. 2, its momentum will propel it off the ramp and onto track section 86. Track section 86 is flat and has an extended wall 96 in the area where the toy vehicle is propelled through the air. Likewise, it contains an inner wall 94' between lane 20 and lane 22. This wall will serve to guide the toy vehicle back towards lane 22, to the normal width of the track. In addition, wall 94' includes an extended portion 96' in the area where the toy vehicle has left the ramp. These extended walls will help in holding the toy vehicle above the current supply strips in lane 20 as it passes off the ramp, so that the vehicle will not always leave the track when flying off the ramp. When the vehicle moves off the ramp, current supplied to the motor terminates while the vehicle is in the air, and its motor slows down. Thus, the toy vehicle, when it returns to the track, will move at a slower rate of speed and must accelerate to its racing speed thereafter. This will slow the vehicle down in the race game. Thus, it would be more desirable for the player, if possible, to remain in lane 22 through the detour track section. On the other hand, if drone vehicle 28 is approaching the track section and the player cannot control his toy vehicle to pass through the track section along lane 22 before colliding with the drone vehicle 28 the player must steer his toy vehicle into lane 20 before entering the detour track section so that his vehicle goes over the jump 92. With skillful timing the player could in some cases maintain his vehicle in lane 22 and, when exiting the detour track section at the end of track member 86, steer his vehicle immediately into the lane 20, as illustrated at the right in FIG. 2 to avoid collision with the drone vehicle.

In lieu of a detour track section with a jump in it, the lane 20 thereof may simply be formed to be longer than the lane 22 so that it takes a vehicle more time to pass from one end of the detour track section 86 in lane 20 than in lane 22. This in effect causes that vehicle to lose ground in the race.

In accordance with another feature of the present invention the track sections 84, 86 are three lanes wide at their adjacent ends to provide a third powered lane 100 between lanes 20, 22. This lane has current supply strips A, B and C formed therein electrically connected to the other current supply strips in the track, as illustrated in FIG. 5. These current supply strips have a finite length within track section 84, 86 and provide a "parking" area or siding into which a controllable toy vehicle may be steered and stopped while the drone vehicle passes through the detour track section. For example, a player whose controllable toy vehicle is approaching the detour track section may determine that the drone vehicle is approaching the detour track section too closely for him to have his controllable vehicle pass entirely through the detour track section without a collision, but that the drone vehicle is sufficiently far away to enable him to enter the detour track section and steer his controllable toy vehicle into lane 100 while the drone vehicle passes in the opposite direction. In lane 100 the player can either stop his toy vehicle by releasing the trigger on his controller so that no current is supplied to the toy vehicle and it comes to a halt in the lane or he may operate his controllable vehicle slowly in that lane while the drone passes. In either case, he avoids jump 92. This sequence requires a certain degree of skill in operating the toy vehicle game, since it requires the player to operate his controller so that his vehicle is steered or biased from inner lane 22 towards the outer lane at precisely the right time. If this operation is performed too soon (i.e. if the controller switch 136 is operated too soon) the vehicle may enter the detour track section 20 before it can engage wall 94, thereby entering the ramp lane. On the other hand, if it is done too late, the vehicle may collide with the oncoming drone car.

Accordingly, it is seen that a toy vehicle game is provided within which a high degree of risk is provided to players during the operation of the game. Substantial time can be lost by the players in a head-on collision with the drone vehicle. Thus, the player, when passing the detour track section, must determine whether to permit his toy vehicle to enter the jump, or to enter the third or siding lane 100, or to attempt to pass entirely through the detour track section. Each of these decisions has some danger involved in it in either colliding the drone vehicle or jumping the track, and the player must decide which alternative to choose given the rate of speed of travel of his controllable toy vehicle and the position of the drone along the track. Thus, an exciting and fast moving game requiring numerous decisions by the player during the course of play is provided.

Although an illustrative embodiment of the invention has been described herein with reference to the accompanying drawings it is to be understood that the invention is not limited to that precise embodiment, and that various other changes and modifications may be effected therein by one skilled in the art without departing from the scope or spirit of this invention.

What is claimed is:

1. A toy vehicle game comprising a flat slotless track defining at least two vehicle lanes permitting toy vehicles to move along the track surface in two generally parallel paths of travel, at least one controllable toy vehicle including an electric motor and means for causing the vehicle to switch from one lane to the other; current supply means in said track for supplying current to said motor and operator operable control means for controlling the supply of current to said motor and actuating said means for causing the vehicle to switch lanes, and a drone vehicle constrained for movement in one of said lanes in a direction opposite to that of said controllable vehicle; said track including a detour track section having guide walls defining a lane section in the other of said lanes directing a controllable toy vehicle in said other lane along a path of travel initially away from said one lane and than back towards said one lane whereby a controllable vehicle on said track can be operated to move into said other lane before entering said detour track section to avoid collision with a drone vehicle in or approaching said detour track section in said one lane.

2. A toy vehicle game as defined in claim 1 including at least two controllable toy vehicles and separate operator operable control means respectively associated with said controllable toy vehicles enabling players to separately control the speed and lane of their respective controllable vehicle.

3. A toy vehicle game as defined in claim 2 wherein said detour track section includes a portion which is at least three lanes wide and has a third lane between said pair of lanes into which a controllable vehicle may be directed from said other lanes to avoid collision with said drone vehicle.

4. A toy vehicle as defined in claim 3 including current supply means in said third lane.

5. A toy vehicle as defined in claim 4 wherein said detour track section includes a ramp jump formed therein.

6. A toy vehicle game as defined in claim 5 wherein said track includes a guide wall along the side thereof adjacent said one lane and said drone vehicle includes a clip slidably engaged with said guide wall to constrain movement of said drone vehicle to said one lane.

7. A toy vehicle game as defined in claim 3 wherein said third lane includes current supply means for selectively supplying current to said controllable vehicle.

* * * * *